US010612482B2

(12) United States Patent
Koo et al.

(10) Patent No.: US 10,612,482 B2
(45) Date of Patent: Apr. 7, 2020

(54) METHOD FOR CONTROLLING STABILIZATION OF EXHAUST GAS RECIRCULATION GAS SUPPLY AND VEHICLE EMPLOYING THE SAME

(71) Applicants: Hyundai Motor Company, Seoul (KR); Kia Motors Corporation, Seoul (KR)

(72) Inventors: Tae-Hyung Koo, Seoul (KR); Neung-Seop Oh, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 26 days.

(21) Appl. No.: 15/858,371

(22) Filed: Dec. 29, 2017

(65) Prior Publication Data

US 2019/0032587 A1 Jan. 31, 2019

(30) Foreign Application Priority Data

Jul. 28, 2017 (KR) ..... 10-2017-0096055

(51) Int. Cl.

| | |
|---|---|
| ***F02D 41/14*** | (2006.01) |
| ***F02M 26/04*** | (2016.01) |
| ***F02D 41/22*** | (2006.01) |
| ***F02D 41/00*** | (2006.01) |

(52) U.S. Cl.

CPC ..... *F02D 41/144* (2013.01); *F02D 41/005* (2013.01); *F02D 41/0055* (2013.01); *F02D 41/222* (2013.01); *F02M 26/04* (2016.02); *F02D 2200/0406* (2013.01); *F02D 2200/0418* (2013.01)

(58) Field of Classification Search

CPC ..... F02D 41/144; F02D 41/005; F02D 2200/0418; F02M 26/04

USPC ..... 123/568.12

See application file for complete search history.

(56) References Cited

U.S. PATENT DOCUMENTS 5,309,887 A * 5/1994 Kondo ..... F02D 41/0055 123/568.16
5,698,780 A * 12/1997 Mizutani ..... F02D 41/222 73/114.33
5,808,189 A * 9/1998 Toyoda ..... F02D 41/222 73/114.37

(Continued)

FOREIGN PATENT DOCUMENTS

JP 2001107811 A * 4/2001
JP 2009287392 A * 12/2009 ..... F02D 41/0055

(Continued)

*Primary Examiner* — Mahmoud Gimie

(74) *Attorney, Agent, or Firm* — Morgan, Lewis & Bockius LLP

(57) ABSTRACT

A method for controlling stabilization of an exhaust gas recirculation (EGR) gas supply may include executing an intake detector condensation stuck resolving mode including, when output abnormality of an intake detector provided at an intake manifold and a variation amount of an EGR rate of an EGR system are detected by a controller while the EGR system is operated, stopping an operation of an EGR valve of the EGR system and then re-operating the EGR valve to resolve abnormality of the intake detector, which is caused by condensation of the EGR gas which is supplied to the intake manifold.

17 Claims, 6 Drawing Sheets

(56) References Cited

U.S. PATENT DOCUMENTS

| | | | | |
|---|---|---|---|---|
| 7,100,586 | B2 * | 9/2006 | Matsumoto | F02D 41/0055 123/568.16 |
| 8,490,610 | B2 * | 7/2013 | Kato | F02D 41/126 123/198 DB |
| 2003/0106728 | A1 * | 6/2003 | Kitajima | B60K 6/485 180/65.26 |
| 2008/0270011 | A1 * | 10/2008 | Takahashi | G01M 15/042 701/114 |
| 2012/0240671 | A1 * | 9/2012 | Tanaka | F02D 41/0077 73/114.74 |
| 2013/0145830 | A1 * | 6/2013 | Kim | F02D 41/123 73/114.74 |
| 2018/0038760 | A1 * | 2/2018 | Choi | G01L 13/00 |

FOREIGN PATENT DOCUMENTS

| | | | | |
|---|---|---|---|---|
| JP | 5056680 | B2 * | 10/2012 | |
| KR | 2002-0027913 | A | 4/2002 | |
| WO | WO-2008032472 | A1 * | 3/2008 | F02D 41/0055 |
| WO | WO-2010067712 | A1 * | 6/2010 | F02D 41/126 |
| WO | WO-2012059984 | A1 * | 5/2012 | F02D 41/221 |

* cited by examiner

METHOD FOR CONTROLLING STABILIZATION OF EXHAUST GAS RECIRCULATION GAS SUPPLY AND VEHICLE EMPLOYING THE SAME

CROSS-REFERENCE TO RELATED APPLICATION

The present application claims priority to Korean Patent Application No. 10-2017-0096055, filed on Jul. 28, 2017, the entire contents of which is incorporated herein for all purposes by the present reference.

BACKGROUND OF THE INVENTION

Field of the Invention

The present invention relates to an exhaust gas recirculation (EGR) gas supply control; and more particularly, to a vehicle implementing a control method configured for rapidly resolving a condensation phenomenon caused by EGR gas which is some of exhaust gas being supplied to an intake manifold.

Description of Related Art

Generally, an exhaust gas recirculation (EGR) system (hereinafter, referred to as an EGR system) includes an EGR valve provided at an EGR line which is connected from a front end portion of a turbine of a turbo charger to an intake manifold and controlled by electronic control unit (ECU), and an EGR cooler by-pass valve.

That is, the EGR system recirculates some of exhaust gas, which is discharged to an exhaust manifold, to the intake manifold as EGR gas so that the EGR gas and new intake air are mixed with each other to be delivered to a combustion chamber. As such, the EGR gas is involved in combustion to reduce a temperature rising rate due to an action of carbon dioxide having large heat capacity when compared to the same amount of fuel combustion, and also to reduce a combustion speed with an oxygen content which is less than air, lowering a maximum combustion temperature.

Consequently, the EGR system is necessarily used even in a hybrid electric vehicle (hereinafter, referred to as an HEV), which employs an engine as well as a motor as power source, to prevent a knocking phenomenon due to an abnormally high temperature of a mixture, and also to dramatically reduce a NOx amount contained in exhaust gas.

Specifically, an EGR control system of the HEV is associated with a manifold air pressure (MAP) detector or a manifold absolute pressure (MAP) detector to determine a failure of an EGR valve which adjusts a circulation amount of EGR gas according to an opening amount of the EGR valve, securing operation stability of the EGR system.

As one example, the MAP detector is disposed inside an intake manifold and measures a flow rate of air supplied to an engine to sense pressure variation when an opening angle of an EGR valve inside the intake manifold is varied, and the EGR control system utilizes the pressure variation, which is detected by the MAP detector when the opening angle of an EGR valve is varied, in a failure diagnosis of the EGR valve.

Consequently, the HEV may execute a failure detection strategy (or logic) of the EGR valve in the EGR control system in association with the MAP detector, continuously maintaining effects in which a knocking phenomenon of an engine of the EGR system is prevented and a NOx amount contained in exhaust gas is reduced.

However, the EGR control system has a limitation in which an MAP detector failure condition is not reflected to the failure detection strategy (or logic) of the EGR valve in association with the MAP sensor.

As one example, the MAP detector is exposed to outside air, which is suctioned into the intake manifold, and a temperature and humidity of the EGR gas being recirculated, and in such a circumstance, condensation is formed on a surface of the MAP detector in a supersaturation condition of the EGR gas to be developed into a phenomenon of an MAP detector stuck, and thus the MAP detector stuck is inevitably developed into an MAP detector failure that causes a loss of detecting ability.

As a result, the HEV cannot return to an efficient combustion process through an EGR gas supply.

The information disclosed in this Background of the Invention section is only for enhancement of understanding of the general background of the invention and may not be taken as an acknowledgement or any form of suggestion that this information forms the related art already known to a person skilled in the art.

BRIEF SUMMARY

Various aspects of the present invention are directed to providing a method for controlling stabilization of an exhaust gas recirculation (EGR) gas supply and a vehicle employing the same, which are configured for rapidly resolving a phenomenon of an intake detector stuck by analyzing a mechanism of a detector condensation phenomenon, which is caused to an intake detector configured to detect a pressure or a flow rate of intake air due to a supersaturation state of the EGR gas, to apply a stuck index, and specifically, since the phenomenon of the intake detector stuck is rapidly resolved, by continuously supplying an EGR gas to achieve continuous efficient combustion.

Other objects and advantages of the present invention can be understood by the following description, and become apparent with reference to the exemplary embodiments of the present invention. Also, it is obvious to those skilled in the art to which the present invention pertains that the objects and advantages of the present invention can be realized by the means as claimed and combinations thereof.

In accordance with various exemplary embodiments of the present invention, a method for controlling stabilization of an EGR gas supply may include an intake detector condensation stuck resolving mode, and the intake detector condensation stuck resolving mode may include (A) when an EGR valve of an EGR system is operated, detecting and monitoring in a controller an output of an intake detector provided at an intake manifold and an EGR rate of the EGR system, (B) continuing the monitoring for a specific time and stopping the monitoring, (C) after the stopping of the monitoring, determining output abnormality of the intake detector, (D) when the output abnormality is determined, determining a variation amount of the EGR rate, (E) when the variation amount is determined, determining an intake detector condensation stuck of the intake detector, which is caused by condensation of EGR gas which is supplied to the intake manifold, (F) when the intake detector condensation stuck is determined, changing an intake detector condensation stuck index to "1," stopping an operation of the EGR valve of the EGR system for a stop time, and then re-operating the EGR valve, and (G) when the intake detector condensation stuck index is maintained as "1" after the re-operating of the EGR system, switching to an intake detector abnormality diagnosis mode for determining the output abnormality of the intake sensor.

As an exemplary embodiment of the present invention, the output abnormality may be determined as a case in which, after a difference between a detected maximum value of the intake detector and a detected minimum value thereof is compared to an intake detector tolerance set value of 5 hectopascal (hPa) by setting the specific time to 80 seconds, the difference is equal to or greater than the intake detector tolerance set value.

As an exemplary embodiment of the present invention, the variation amount may be determined as a case in which, after a difference between a maximum value of the EGR rate and a minimum value thereof is compared to an EGR tolerance set value of 0% by setting the specific time to 80 seconds, the difference is not the EGR tolerance set value.

As an exemplary embodiment of the present invention, the stop time may be 300 seconds.

As an exemplary embodiment of the present invention, the intake detector abnormality diagnosis mode may include (g-1) after the re-operating of the EGR system, repetitively performing the monitoring by re-detecting an output of the intake detector and an EGR rate of the EGR system, (g-2) after stopping the repetitive performing of the monitoring for a monitoring repetition time, redetermining the output abnormality of the intake detector, (g-3) when the output abnormality is redetermined, redetermining a variation amount of the EGR rate, (g-4) when the variation amount is redetermined, maintaining the intake detector condensation stuck index as "1," and diagnosing abnormality of the intake detector, and (g-5) after the diagnosing of the abnormality of the intake detector, checking a failure of the intake detector, and, when the failure of the intake detector is checked, stopping the operation of the EGR system.

As an exemplary embodiment of the present invention, the redetermined output abnormality may be determined as a case in which, after a difference between a re-detected maximum value of the intake detector and a re-detected minimum value thereof is compared to the intake detector tolerance set value of 5 hPa by setting the monitoring repetition time to 80 seconds, the difference is equal to or greater than the intake detector tolerance set value.

As an exemplary embodiment of the present invention, the redetermined variation amount may be determined as a case in which, after a difference between a re-detected maximum value of the EGR rate and a re-detected minimum value thereof is compared to the EGR tolerance set value of 0% by setting the monitoring repetition time to 80 seconds, the difference is not the EGR tolerance set value.

In accordance with various exemplary embodiments of the present invention, a vehicle may include a controller configured to execute an intake detector condensation stuck resolving mode in which, when an output of an intake detector provided at an intake manifold and an EGR rate are detected, and output abnormality of the intake detector and a variation amount of the EGR rate are detected by the controller while an EGR system is operated, an operation of the EGR system is stopped and then is re-operated to resolve abnormality of the intake detector, wherein the abnormality is caused by condensation of EGR gas which is supplied to the intake manifold, and to execute an intake detector abnormality diagnosis mode in which, when an intake detector condensation stuck is not resolved after the EGR system is re-operated, the abnormality of the intake detector is diagnosed, and a failure of the intake detector is checked; and an engine system configured to supply the EGR gas under the control of the controller.

As a preferable embodiment, the controller may be associated with an EGR stabilization map, and the EGR stabilization map is provided with an EGR rate map of the EGR gas.

As a preferable embodiment, the engine system may be provided with the EGR system and configured to supply the EGR gas to the intake manifold which is connected to an engine using gasoline as fuel under the control of the controller, and the intake detector configured to detect an internal pressure of the intake manifold and transmit a signal of the detected internal pressure to the controller, and the engine may configure a hybrid electric vehicle in association with a motor which is connected to and disconnected from the engine through a clutch.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
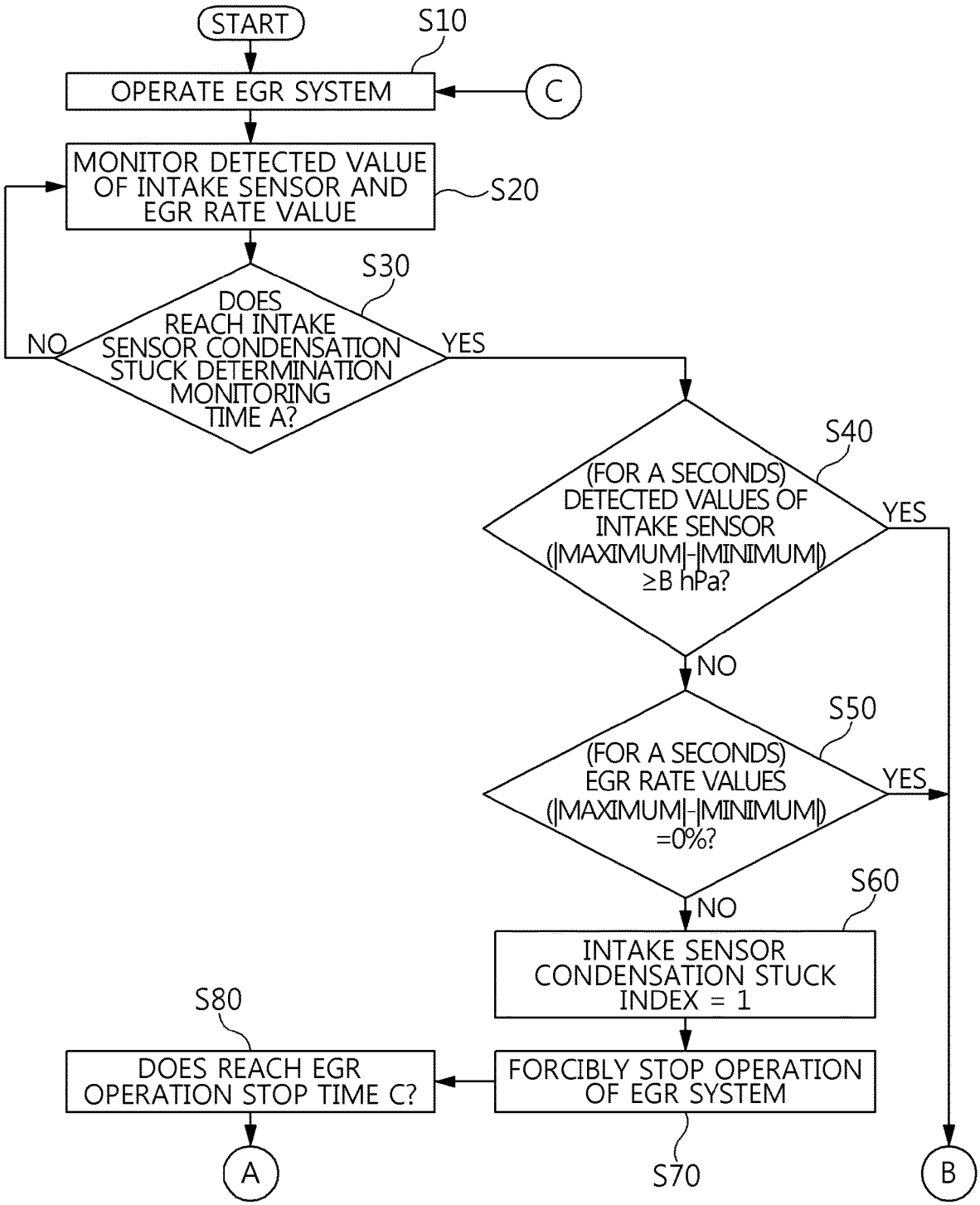
FIG. 1 and FIG. 2 are flowcharts each illustrating a method for controlling stabilization of an exhaust gas recirculation (EGR) gas supply according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will be described below in more detail with reference to the accompanying drawings. The present invention may, however, be embodied in different forms and should not be construed as limited to the exemplary embodiments set forth herein.

Figure 2:
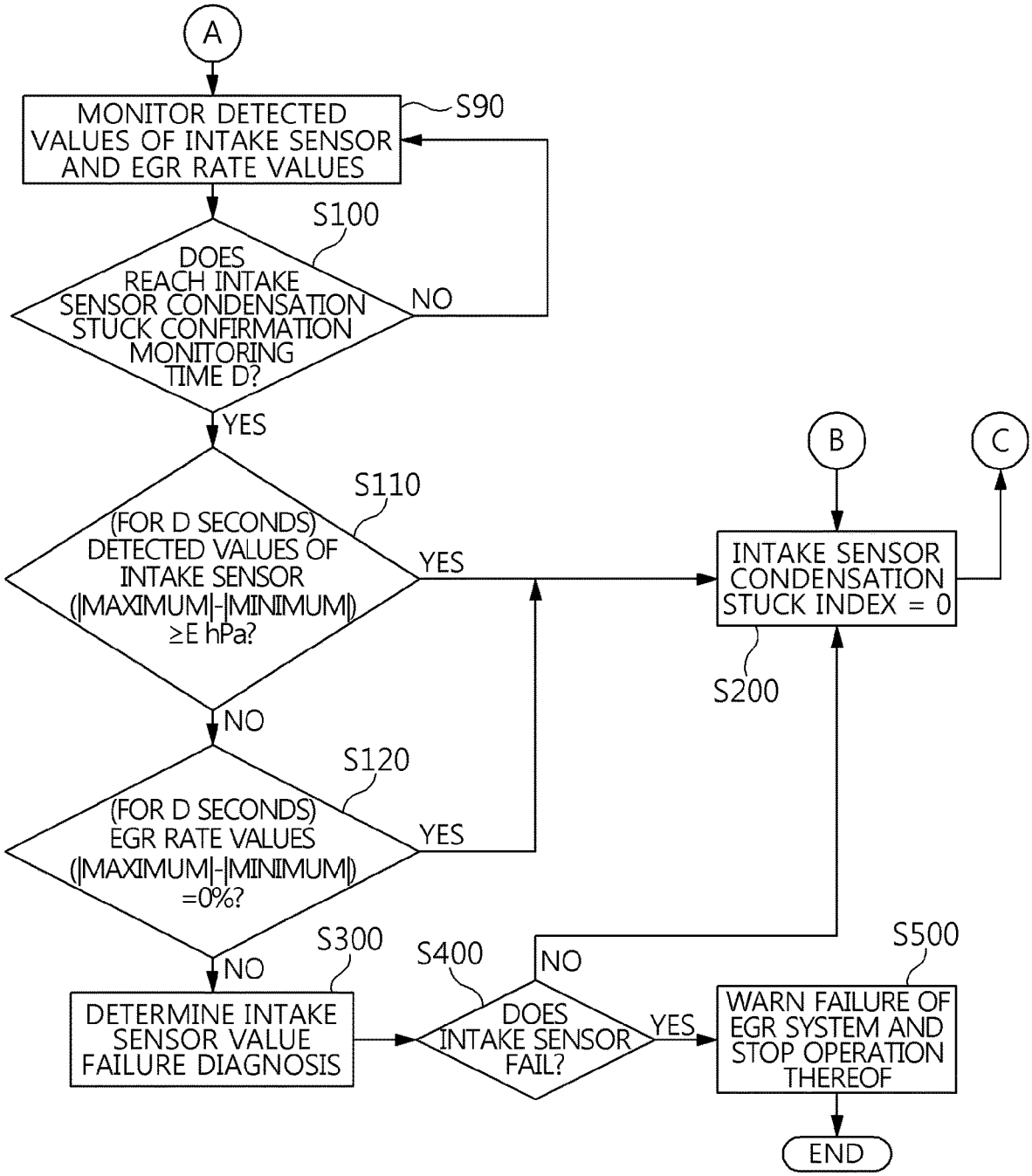

Referring to FIG. 1 and FIG. 2, a method for controlling stabilization of exhaust gas regulation (EGR) gas supply executes an intake detector condensation stuck resolving mode, and the intake detector condensation stuck resolving mode includes determining an intake detector condensation stuck caused by condensation of EGR gas based on output abnormality of an intake detector and a variation amount of an EGR rate, which are monitored while an EGR system is operated, and then forcibly stopping an operation of the EGR system (for example, controlling of an opening amount of an EGR valve) (S10 to S70), and determining that the intake detector is normal based on the output abnormality of the intake detector and the variation amount of the EGR rate which are re-monitored after the forcibly stopping of EGR operation as the condensation of the EGR gas, which is a cause of the determination that a manifold air pressure (MAP) detector or a manifold absolute pressure (MAP) detector is stuck, is resolved (S80 to S120 and S200), or changing the determining of the intake detector condensation stuck to diagnosing an intake detector failure (S80 to S120, and S300), and confirming a failure of the intake detector according to the diagnosing of the intake detector failure as well as warning an failure of the EGR system and stopping an operation of the EGR system (S400 and S500).

Consequently, the intake detector condensation stuck resolving mode stops the operation of the EGR system when the output of the intake detector provided at the intake manifold and the EGR rate are detected and the output abnormality of the intake detector and the variation amount of the EGR rate are detected by a controller while the EGR system is operated, and thus the failure of the intake detector resulting from the condensation of the EGR gas provided to the intake manifold or not resulting therefrom may be determined.

As a result, the method for controlling stabilization of an EGR gas supply is configured for rapidly recognizing a situation in which the operation of the intake detector is disabled, which is caused by a condensation phenomenon due to a temperature and humidity of the mixture of outside air and the EGR gas, in a gasoline engine which is mounted on a vehicle (specifically, an HEV) and employs the EGR system, and specifically, the method is configured for rapidly resolving the intake detector stuck phenomenon through an EGR control strategy of the EGR system, which escapes a condensation generation condition, preventing an unnecessary diagnosis for the intake detector failure with respect to a normal intake detector and at the same time returning to an efficient combustion process by supplying again the EGR gas.

Hereinafter, the method for controlling stabilization of an EGR gas supply will be described more specifically with reference to FIG. 3, FIG. 4, FIG. 5 and FIG. 6. In the instant case, a control subject is a controller 6 associated with an EGR stabilization map 6-1, and control targets are an EGR valve 3-1 of an EGR system 3 and an intake detector 5 configured to detect an air pressure being delivered inside an intake manifold 2-1. The intake detector 5 is a detector configured to detect a pressure or a flow rate of intake air, and includes a manifold air pressure (MAP) detector or a manifold absolute pressure (MAP) sensor.

The controller 6 first performs detecting of an intake detector condensation stuck determination variable. The detecting of the intake detector condensation stuck determination variable includes operation (S10) of controlling an operation of the EGR system 3, operation (S20) of monitoring a detected value of the intake detector 5 and an EGR rate value, and operation (S30) of setting a predetermined set time to a monitoring time set value A with respect to an intake detector condensation stuck determination monitoring time and, stopping the monitoring of the detected value while the intake detector condensation stuck determination monitoring time reaches the monitoring time set value A. Here, the monitoring time set value A is set to about 80 seconds.

Figure 3:
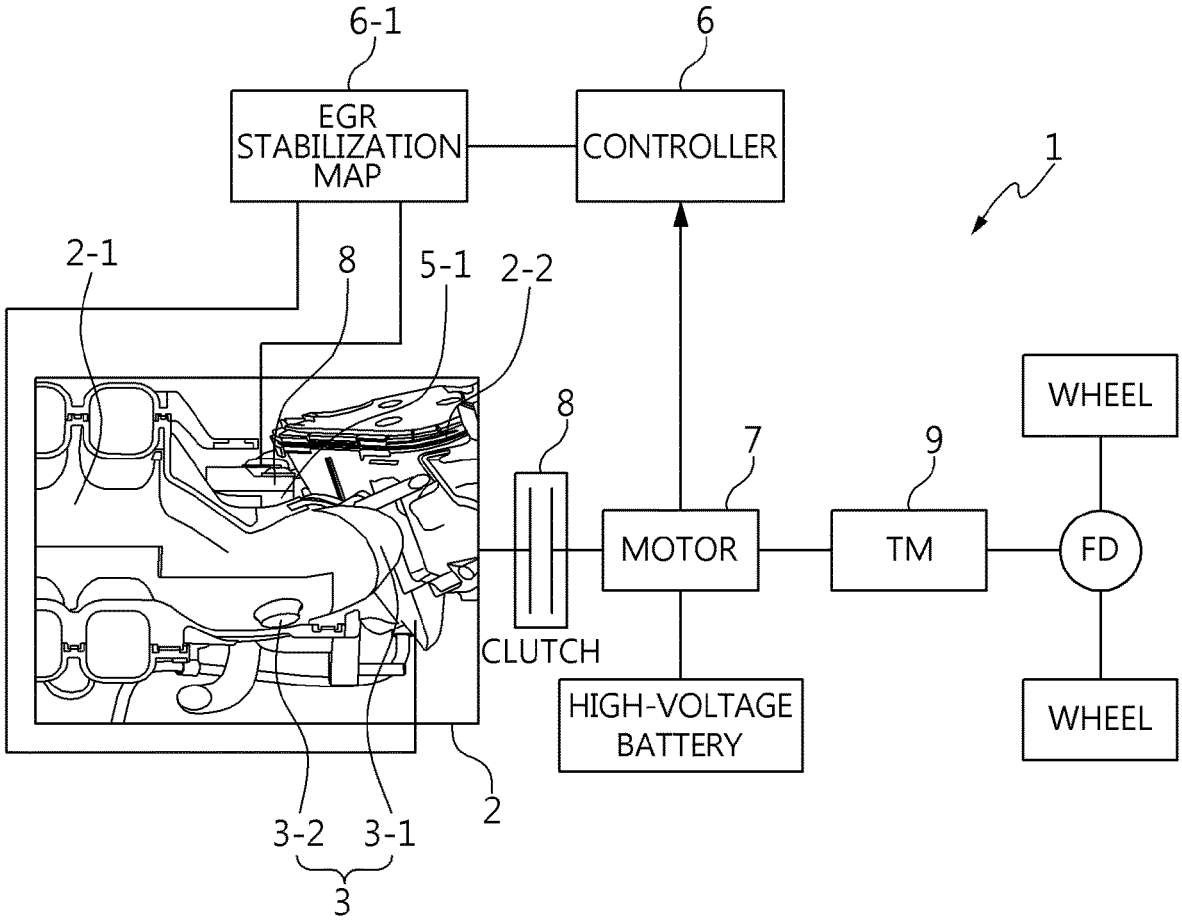
FIG. 3 is a diagram illustrating an example of a hybrid electric vehicle in which the method for controlling stabilization of an EGR gas supply according to an exemplary embodiment of the present invention is implemented.

Referring to FIG. 3, a vehicle 1 includes an engine system 2 provided with an engine 2-2 which receives a mixture of air and gasoline through the intake manifold 2-1, the EGR system 3 configured to EGR gas to the EGR valve 3-1 which opens and blocks an EGR line 3-2 connected to the intake manifold 2-1, the intake detector 5 configured to detect an air pressure being delivered inside the intake manifold 2-1, the controller 6 associated with the EGR stabilization map 6-1, a motor 7 configured to generate power with electricity and connected to and separated from the engine 2-2 through a clutch 8, and a transmission 9 configured to shift a transmission stage. Therefore, the vehicle 1 is an example of an HEV to which a gasoline engine is applied.

The controller 6 controls an opening angle of the EGR valve 3-1 and at the same time reads the detected value of the intake detector 5, and specifically, the controller 6 determines difference values between the ERG rate values with respect to a variation amount of an EGR gas supply and between the detected values of the intake detector 5 using the EGR stabilization map 6-1. The EGR stabilization map 6-1 is provided with a two-dimensional EGR rate map in which a flow rate of the EGR gas is matched to the opening angle of the EGR valve 3-1, and the EGR rate map provides variation of EGR rate against a time as the EGR rate value.

Figure 4:
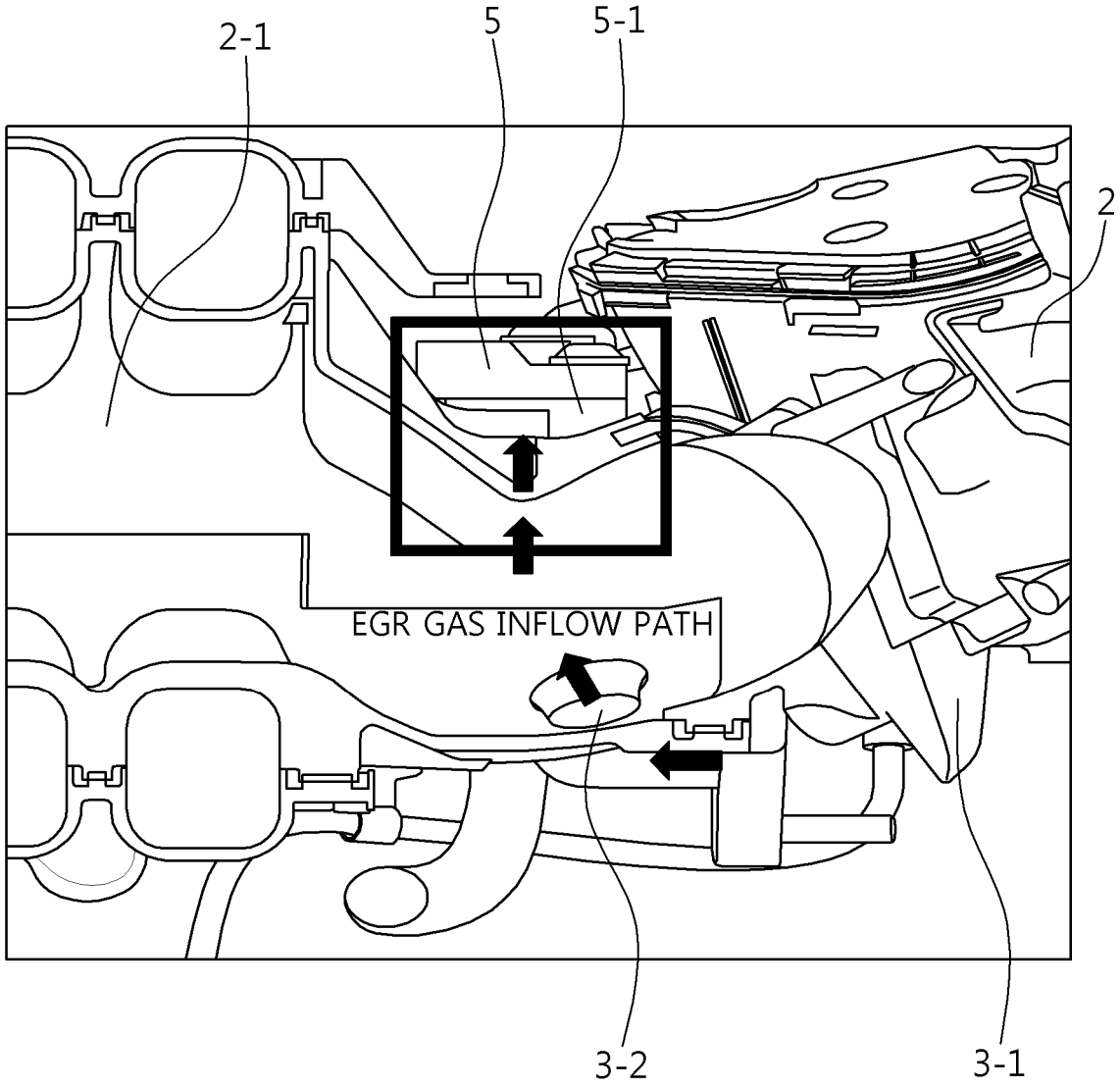
FIG. 4 is a diagram illustrating a disposition state of an EGR gas path and an intake detector in the vehicle according to an exemplary embodiment of the present invention.

Referring to FIG. 4, the EGR valve 3-1 is provided at the EGR line 3-2 and is controlled by the controller 6, and the EGR line 3-2 is connected from a turbo charger, which is connected to an exhaust manifold of the engine 2-2, to the intake manifold 2-1. Furthermore, the intake detector 5 is positioned on an internal path through an intake detector installation portion 5-1 of the intake manifold 2-1 and provides the detected value to the EGR stabilization map 6-1, and the intake detector installation portion 5-1 is formed as a screw hole where the intake detector 5 is detached from and attached to the screw hole at a portion, to which the EGR line 3-2 is connected, through a rib portion of the intake manifold 2-1. Accordingly, the detected value of the intake detector 5 is converted into a supply flow rate of the EGR gas, Therefore, in the detecting of the intake detector dew condensation stuck determination variable, the controller 6 controls the EGR system 3 in association with an operation of the engine 2-2 to operate the EGR system 3 in operation (S10), detects the air pressure, which is detected by the intake detector 5 provided at the intake manifold 2-1 and is delivered inside the intake manifold 2-1, to monitor the detected value of the intake detector 5 in operation (S20), and monitors the EGR rate value based on the opening angle of the EGR valve 3-1. The controller 6 may use a timer or a counter to verify an intake detector condensation stuck determination monitoring time an in operation (S30).

Subsequently, when a time reaches the intake detector condensation stuck determination monitoring time A, the controller 6 performs the determining of the intake detector condensation stuck caused by the condensation of the EGR gas with respect to the intake detector 5. The determining of the intake detector condensation stuck includes operation (S40) of comparing with detected values of the intake detector 5, operation (S50) of comparing with EGR rate values, operation (S60) of generating an intake detector condensation stuck index, and operation (S70) of forcibly stopping an operation of the EGR system. Here, the intake detector condensation stuck index is defined by a stuck bit of 0 or 1, 0 refers to a normal detector state, and 1 refers to an abnormal detector state.

Operation (S40) of comparing with the detected values of the intake detector 5 is performed through an intake detector stuck determination equation.

$$|\text{Maximum detected value of intake detector for } A| - |\text{Minimum detected value of intake detector for } A| \geq B \qquad \text{Intake detector Stuck Determination Equation}$$

Here, "A" is about 80 seconds by setting a monitoring time to a predetermined monitoring set time, "B" is about 5 hectopascal (hPa) by setting a detector detection tolerance difference value with respect to the detected values of the intake detector 5 to a predetermined detector detection tolerance set value, "|" is an absolute value, "−" is a subtraction operation sign, "≥" is an inequality sign representing a magnitude between two values, and "Maximum detected value of intake detector for A|−|Minimum detected value of intake detector for A|≥B" means that "|Maximum detected value of intake detector for A|−|Minimum detected value of intake detector for A|" is equal to or greater than B.

As a result, when an absolute value difference between a maximum value and a minimum value of the detected values of the intake detector 5, which are monitored for about 80 seconds, is equal to or greater than about 5 hPa, the operation of the intake detector 5 is determined as not being influenced by the condensation of the EGR gas such that, as in operation (S200), the intake detector condensation stuck index is maintained as "0," and the controller 6 returns to operation (S10) to maintain controlling of the EGR system. On the other hand, when the absolute value difference between the maximum value and the minimum value of the detected values of the intake detector 5, which is monitored for about 80 seconds, is less than or equal to about 5 hPa, the operation of the intake detector 5 is determined as being influenced by the condensation of the EGR gas such that the controller 6 executes operation (S50).

Operation (S50) of comparing with the EGR rate values is performed through an EGR rate determination equation.

$$|\text{Maximum EGR rate value for } A| - |\text{Minimum EGR rate value for } A| = B\text{-}1 \qquad \text{EGR Rate Determination Equation}$$

Here, "A" is about 80 seconds by setting a monitoring time to a predetermined monitoring set time, "B−1" is 0% by setting a tolerance difference value of the EGR rate value to a predetermined EGR detection tolerance set value, "|" is an absolute value, "−" is a subtraction operation sign, "=" is an inequality sign representing a magnitude between two values, and "|Maximum EGR rate value for A|−|Minimum EGR rate value for A|=B−1" means that "|Maximum EGR rate value for A|−|Minimum EGR rate value for A|" is equal to "B−1."

As a result, when the absolute value difference between the maximum value and the minimum value of the EGR rate values, which are verified (or calculated) from a map, is 0% based on the opening angle of the EGR valve 3-1, which is monitored for about 80 seconds, the condensation of the EGR gas is determined as not being formed around the intake detector 5 such that, as in operation (S200), the intake detector condensation stuck index is maintained as "0," and the controller 6 returns to operation (S10) to maintain the controlling of the EGR system. On the other hand, when the absolute value difference between the maximum value and the minimum value of the EGR rate values, which are verified (or calculated) from the map, is not 0% based on the opening angle of the EGR valve 3-1, which is monitored for about 80 seconds, the condensation of the EGR gas is determined as being formed around the intake detector 5 such that the controller 6 executes operation (S60).

Operation (S60) of generating the intake detector condensation stuck index changes the intake detector condensation stuck index from "0" to "1," and the changed intake detector condensation stuck index of 1 is applied to a lighting signal of a warning lamp. A configuration of an ON/OFF circuit of the warning lamp is the same as a typical configuration of an ON/OFF circuit for warning abnormality of the EGR system or another system.

Operation (S70) of forcibly stopping the operation of the EGR system 3 refers to a supply stop of the EGR gas to the intake manifold 2-1 according to an operation stop of the EGR valve 3-1. Therefore, the supply stop of the EGR gas refers to a blocking of the EGR line 3-2, and the blocking of the EGR line 3-2 refers to a blocking of the EGR valve 3-1 (that is, the opening angle is 0%). Consequently, in operation (S70) of forcibly stopping the operation of the EGR system 3, the EGR gas is discharged as exhaust gas.

Figure 5:
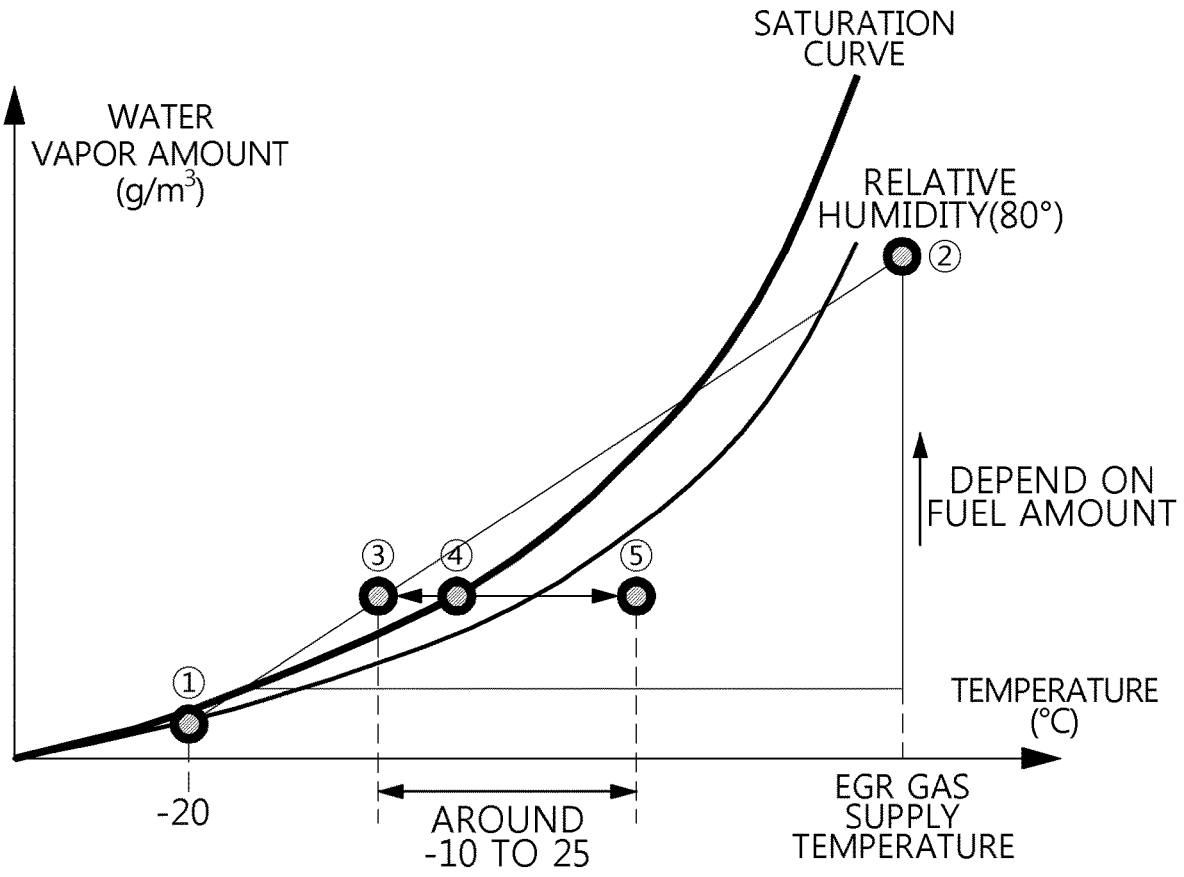
FIG. 5 is a graph illustrating a phase change characteristic of an intake air temperature (or an outside air temperature) due to an EGR gas according to an exemplary embodiment of the present invention.

Referring to FIG. 5, it can be seen an example of a condensation formation of the EGR gas using a water vapor-temperature graph of the EGR gas. Here, ①, ②, ③, ④, and ⑤ refer to a phase change of an intake air temperature (or an outside air temperature) by the EGR gas.

① is an initial intake air temperature (or an initial outside air temperature) in a state of an extremely low temperature of −20° C. and high relative humidity of 80%. In the instant case, the intake air temperature (or the outside air temperature) is assumed as being in an unsaturation state. ② is a temperature of the EGR gas and the EGR gas is supplied inside the intake manifold 2-1 through the EGR line 3-2 connected to the intake manifold 2-1. Moisture is additionally generated in the EGR gas during combustion. Also, the temperature of the EGR gas is assumed as a temperature after the EGR gas is cooled using an EGR cooler. Each of ③ and ④ is a supersaturation section to which a failure diagnosis is applied since a detector stuck occurs due to a detector surface condensation of the intake detector 5. ⑤ is an unsaturation section in which the intake detector 5 operates normally since water vapor is unsaturated due to temperature and humidity conditions of a mixture (obtained by mixing outside air with the EGR gas). Therefore, since ③ to ⑤ have a temperature region in a range of −10° C. to 25° C., condensation generation of the EGR gas may be predicted based on a temperature and humidity of the mixture (obtained by mixing the outside air with the EGR gas) according to a mixing condition of the outside air (the air) and the EGR gas.

Subsequently, as in operation (S80), the controller 6 continuously stops the operation of the EGR operation until an EGR system operation stop time reaches a set value C. In the instant case, the set value C is a predetermined stop time set value, and is set to about 300 seconds. Consequently, after 300 seconds in operation (S80), the controller 6 releases the stopping of the operation of the EGR system 3 to re-operate the EGR system 3.

Thereafter, in a state in which the EGR system 3 is re-operated after the EGR operation stop time passes 300 seconds, the controller 6 performs checking of output abnormality of the intake detector 5 with the intake detector condensation stuck index of "1." The checking of the output abnormality of the intake detector 5 includes operation (S90) of monitoring the detected values of the intake detector 5 and the EGR rate values, and operation (S100) of stopping the monitoring of the detected values of the intake detector 5 and the EGR rate values when an intake detector condensation stuck redetermination monitoring time reaches a set value D. Here, the set value D is set to about 80 seconds. Consequently, the checking of the output abnormality of the intake detector 5 is performed by re-detecting an intake detector condensation stuck determination variable.

Figure 6:
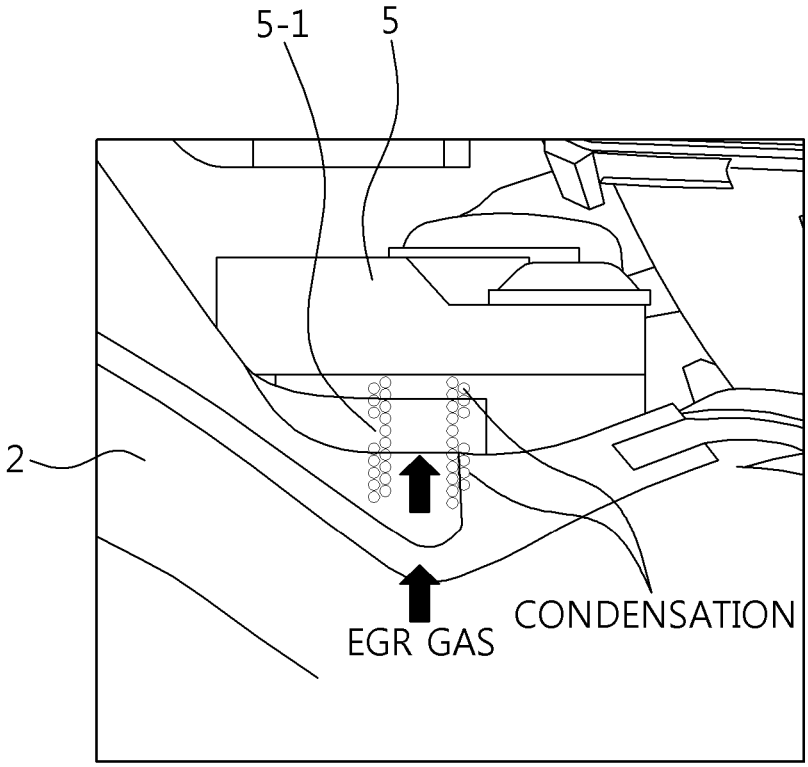
FIG. 6 is a diagram illustrating an example of a condensation state around the intake detector due to the EGR gas according to an exemplary embodiment of the present invention.

Referring to FIG. 6, since the intake detector 5 is coupled to the intake detector installation portion 5-1 of the intake manifold 2-1, it is inevitably affected by condensation of the EGR gas which is supplied to the intake manifold 2-1 through the EGR line 3-2 and then is mixed with the outside air to be changed into the supersaturation state between −10° C. to 25° C. Consequently, as shown in FIG. 5, condensation is formed on a surface of the intake detector 5 by influence of the EGR gas to be developed into the phenomenon of the intake detector stuck, and FIG. 5 exemplifies that the intake detector stuck is developed into an intake detector failure resulting in a loss of detecting ability of the intake detector 5.

Subsequently, when the intake detector condensation stuck redetermination monitoring time reaches the set value D, the controller 6 performs redetermining of the intake detector condensation stuck of the intake detector 5, which is caused by the condensation of the EGR gas. The redetermining of the intake detector condensation stuck includes operation (S110) of re-comparing with the detected values of the intake detector 5, and operation (S120) of re-comparing with the EGR rate values.

Operation (S110) of the re-comparing with the detected values of the intake detector 5 is performed through an intake detector stuck redetermination equation.

$$|\text{Maximum detected value of intake detector for } D| - |\text{Minimum detected value of intake detector for } D| \geq E \qquad \text{Intake detector Stuck Redetermination Equation}$$

Here, "D" is about 80 seconds by setting a monitoring time according to the stopping of the EGR system to a predetermined EGR system stop monitoring set time, "E" is about 5 hPa by setting a tolerance difference value with respect to the detected values of the intake detector 5 to a predetermined detector detection tolerance set value, "||" is an absolute value, "−" is a subtraction operation sign, "≥" is an inequality sign representing a magnitude between two values, and |Maximum detected value of intake detector for D|−|Minimum detected value of intake detector for D|≥E" means that |Maximum detected value of intake detector for D|−|Minimum detected value of intake detector for D|" is equal to or greater than E.

As a result, when an absolute value difference between a maximum value and a minimum value of the detected values of the intake detector 5, which are monitored for about 80 seconds, is equal to or greater than about 5 hPa, the operation of the intake detector 5 is determined as not being influenced by the condensation of the EGR gas such that, as in operation (S200), the intake detector condensation stuck index is maintained as "0," and the controller 6 returns to operation (S10) to maintain the controlling of the EGR system. On the other hand, when the absolute value difference between the maximum value and the minimum value of the detected values of the intake detector 5, which are monitored for about 80 seconds, is less than or equal to about 5 hPa, the operation of the intake detector 5 is determined as being influenced by the condensation of the EGR gas such that the controller 6 executes operation (S120).

Operation (S120) of re-comparing with the EGR rate values is performed through an EGR rate redetermination equation.

$$|\text{Maximum EGR rate value for } D| - |\text{Minimum EGR rate value for } D| = E-1 \qquad \text{EGR Rate Redetermination Equation}$$

Here, "D" is about 80 seconds by setting a monitoring time according to the stopping of the EGR system to a predetermined EGR stop monitoring set time, "E−1" is 0% by setting a tolerance difference value with respect to the EGR rate values to a predetermined EGR detection tolerance set value, "||" is an absolute value, "−" is a subtraction operation sign, "=" is an inequality sign representing a magnitude between two values, and "|Maximum EGR rate value for D|−|Minimum EGR rate value for D|=E−1" means that "|Maximum EGR rate value for D|−Minimum EGR rate value for D|" is equal to "E−1."

As a result, when the absolute value difference between the maximum value and the minimum value of the EGR rate values, which are verified (or calculated) from the map, is 0% based on the opening angle of the EGR valve 3-1, which is monitored for about 80 seconds, the condensation of the EGR gas is determined as not being formed around the intake detector 5 such that, as in operation (S200), the intake detector condensation stuck index of "1" is changed to an intake detector condensation stuck index of "0," and the controller 6 returns to operation (S10) to maintain the controlling of the EGR system. On the other hand, when the absolute value difference between the maximum value and the minimum value of the EGR rate values, which are verified (or calculated) from the map, is not 0% based on the opening angle of the EGR valve 3-1, which is monitored for about 80 seconds, the condensation the EGR gas is determined as not being formed on the surface of the intake detector 5 such that the intake detector condensation stuck index of "1" is maintained and the controller 6 changes the checking of the output abnormality of the intake detector 5 to corresponding of an intake detector failure.

The controller 6 performs the corresponding of the intake detector failure which includes operation (S300) of determining an intake detector failure diagnosis, operation (S400) of checking an intake detector failure, and operation (S500) of warning a failure of the EGR system and stopping the operation thereof.

Operation (S300) of the determining of the intake detector failure diagnosis stops the determining of the intake detector condensation stuck which is caused by the condensation of the EGR gas, and operation (S400) of the checking of the intake detector failure accurately diagnoses abnormality of the detected values of the intake detector 5 through an intake detector failure logic, and thus, when the intake detector 5 is determined as not failing, the controller 6 changes to operation (S200) or to operation (S500) of warning the failure of the EGR system and stopping the operation thereof. Here, the intake detector failure logic refers to a typical logic which is configured to verify the abnormality of the detected values of the intake detector 5 through detector hardware.

Operation (S500) of the warning of the failure of the EGR system and the stopping of the operation thereof is a subsequent action according to the checking of the intake detector failure, and refers to a failure warning of the EGR system 3 through lighting of the warning lamp and to an operation stop according to a control stop of the EGR system 3.

As is described above, when the difference between the maximum detected value and the minimum detected value of the intake detector 5, which are monitored for the specific monitoring time, is less than the tolerance set value and at the same time the variation amount of the EGR rate values of the EGR system 3, which is calculated for the specific monitoring time, the method for controlling stabilization an EGR gas supply to a vehicle determines the intake detector 5 as being stuck due to the condensation of the EGR gas, assigns "1" as the intake detector condensation stuck index, stops a supply of the EGR gas to the EGR system 3, wherein EGR gas is supplied to the intake manifold 2-1 for a specific EGR system stop time, and varies supersaturation temperature and humidity conditions of the mixture around the intake detector 5, avoiding generation condition for the condensation of the EGR gas, and performing the redetermining of the intake detector condensation stuck, and, when variation of the detected values of the intake detector 5 is not detected, the method changes to the determining of the intake detector failure diagnosis according to an unresolved problem of condensation.

Consequently, a control logic for stabilization of an EGR gas supply according to the present embodiment analyzes a mechanism of the condensation of the intake detector, which is caused by a supersaturation state of the EGR gas, and rapidly resolves the phenomenon of the intake detector stuck, and specifically, the phenomenon of the intake detector stuck is rapidly resolved so that efficient combustion may continue.

The vehicle according to an exemplary embodiment of the present invention implements an EGR system stabilization control to which an intake detector failure condition is reflected, realizing advantages and effects as follows.

First, the failure detection strategy (or logic) with respect to the EGR valve resolves a limitation in which the intake detector failure condition of the EGR control system, which is associated with the intake detector, is not reflected. Second, a condensation generation caused by high-temperature humid EGR gas is detected in advance around a position of the intake detector such that influence of the intake detector due to the condensation is eliminated. Third, a condensation problem of the intake detector is self-resolved such that an abnormal operation of the intake detector due to an external factor is detected in advance. Fourth, since the abnormal operation of the intake detector is detected in advance, the failure diagnosis determination due to the intake detector stuck is prevented so that customer complaint according to the operation of the EGR system is prevented. Fifth, abnormality of the detected values of the intake detector is rapidly restored to be normal so that the EGR control may be effectively continued. Sixth, since the EGR control is effectively continued, an engine efficiency is raised and a fuel economy driving is realized. Seventh, stability of the EGR system of the HEV, to which a gasoline engine using the EGR system is applied, is significantly improved.

While the present invention has been described with respect to the specific embodiments, it will be apparent to those skilled in the art that various changes and modifications may be made without departing from the spirit and scope of the invention as defined in the following claims.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for controlling stabilization of an exhaust gas recirculation (EGR) gas supply, which executes an intake detector condensation stuck resolving mode including:

when output abnormality of an intake detector provided at an intake manifold and a variation amount of an EGR rate of an EGR system are detected by a controller while the EGR system is operated, stopping, by the controller, an operation of an EGR valve of the EGR system and then re-operating the EGR valve to resolve abnormality of the intake detector, which is caused by condensation of EGR gas which is supplied to the intake manifold, wherein the intake detector condensation stuck resolving mode includes:

(A) detecting and monitoring an output of the intake detector and the EGR rate of the EGR system;

(B) continuing the monitoring for a predetermined time and then stopping the monitoring;

(C) after the stopping of the monitoring, determining output abnormality of the intake detector;

(D) when the output abnormality is determined, determining the variation amount of the EGR rate;

(E) when the variation amount is determined, determining the intake detector as being an intake detector condensation stuck caused by the condensation of the EGR gas;

(F) when the intake detector condensation stuck is determined, changing an intake detector condensation stuck index, continuing the stopping of the operation of the EGR valve of the EGR system for a stop time, and re-operating the EGR system; and (G) when the changed intake detector condensation stuck index is maintained after the re-operating of the EGR system, changing to an intake detector abnormality diagnosis mode for determining the output abnormality of the intake detector.

2. The method of claim 1, wherein the output abnormality is determined as a case in which, after a difference between a maximum detected value of the intake detector and a minimum detected value thereof for the predetermined time is compared to an intake detector tolerance set value, the difference is equal to or greater than the intake detector tolerance set value.

3. The method of claim 2, wherein the predetermined time is a predetermined monitoring set time, and the intake detector tolerance set value is a predetermined detector tolerance set value.

4. The method of claim 1, wherein the variation amount is determined as a case in which, after a difference between a maximum value of the EGR rate and a minimum value thereof for the predetermined time is compared to an EGR tolerance set value, the difference is not the EGR tolerance set value.

5. The method of claim 4, wherein the EGR tolerance set value is a predetermined EGR detection tolerance set value.

6. The method of claim 1, wherein the stop time is a predetermined EGR system monitoring stop time.

7. The method of claim 1, wherein the intake detector abnormality diagnosis mode includes:

(g-1) after the re-operating the EGR system, repetitively performing the monitoring by re-detecting an output of the intake detector and an EGR rate of the EGR system;

(g-2) after stopping a monitoring repetition time, redetermining the output abnormality of the intake detector;

(g-3) when the output abnormality is redetermined, redetermining the variation amount of the EGR rate; and (g-4) when the variation amount is redetermined, maintaining a state of the changed intake detector condensation stuck index, and diagnosing abnormality of the intake sensor.

8. The method of claim 7, wherein the redetermining of the output abnormality is determined as a case in which, after a difference between a maximum re-detected value of the intake detector and a minimum re-detected value thereof for the monitoring repetition time is compared to an intake detector tolerance set value, the difference is equal to or greater than the intake detector tolerance set value.

9. The method of claim 8, wherein the monitoring repetition time is a predetermined EGR system stop monitoring set time, and the intake detector tolerance set value is a predetermined detector detection tolerance set value.

10. The method of claim 7, wherein the redetermined variation amount is determined as a case in which, after a difference between a maximum re-detected value of the EGR rate and a minimum re-detected value thereof for the monitoring repetition time is compared to an EGR tolerance set value, the difference between the maximum re-detected value of the EGR rate and the minimum re-detected value is not the EGR tolerance set value.

11. The method of claim 10, wherein the EGR tolerance set value is a predetermined EGR detection tolerance set value.

12. The method of claim 7, wherein the intake detector abnormality diagnosis mode further includes (g-5):

after the diagnosing of the abnormality of the intake detector, checking a failure of the intake detector, and, when the failure of the intake detector is checked, stopping an operation of the EGR system.

13. A vehicle comprising:

a controller configured to perform an exhaust gas recirculation (EGR) gas supply stabilization control by executing an intake detector condensation stuck resolving mode in which, when an output of an intake detector provided at an intake manifold and an EGR rate are detected, and output abnormality of the intake detector and a variation amount of the EGR rate are detected by the controller while an EGR system is operated, the controller is configured to stop an operation of the EGR system and then to re-operate the EGR system, thereby resolving abnormality of the intake detector, wherein the abnormality is caused by condensation of EGR gas which is supplied to the intake manifold; and an engine system configured to supply the EGR gas under a control of the controller, wherein the intake detector condensation stuck revolving a mode includes:

detecting and monitoring an output of the intake detector and the EGR rate of the EGR system;

continuing the monitoring for a predetermined time and then stopping the monitoring;

after the stopping of the monitoring, determining the output abnormality of the intake detector;

when the output abnormality is determined, determining the variation amount of the EGR rate;

when the variation amount is determined, determining the intake detector as being an intake detector condensation stuck caused by the condensation of the EGR gas;

when the intake detector condensation stuck is determined, changing an intake detector condensation stuck index, continuing the stopping of the operation of an EGR valve of the EGR system for a stop time, and re-operating the EGR system; and when the changed intake detector condensation stuck index is maintained after the re-operating of the EGR system, changing to an intake detector abnormality diagnosis mode for determining the output abnormality of the intake detector.

14. The vehicle of claim 13, wherein the controller is associated with an EGR stabilization map, and the EGR stabilization map is provided with an EGR rate map of the EGR gas.

15. The vehicle of claim 13, wherein the engine system is provided with the EGR system controlled by the controller and configured to supply the EGR gas to the intake manifold connected to an engine, and the intake detector configured to detect an internal pressure of the intake manifold and transmit a signal of the detected internal pressure to the controller.

16. The vehicle of claim 15, wherein the engine is a gasoline engine.

17. The vehicle of claim 15, wherein the engine is connected to and disconnected from a motor through a clutch.

* * * * *